United States Patent [19]

Newman

[11] Patent Number: 4,525,909

[45] Date of Patent: Jul. 2, 1985

[54] ROLLER FOR SCREEN TENSIONING AND PRINTING FRAME

[75] Inventor: Don Newman, Wyncote, Pa.

[73] Assignee: Stretch Devices, Inc., Philadelphia, Pa.

[21] Appl. No.: 429,752

[22] Filed: Sep. 30, 1982

[51] Int. Cl.[3] ..... D06C 3/08

[52] U.S. Cl. ..... 29/121.1; 38/102.1; 38/102.91

[58] Field of Search ..... 29/121.1; 160/392, 394, 160/395, 397, 278; 38/102.91, 102.1, 102.3, 102.4

[56] References Cited

U.S. PATENT DOCUMENTS

| | | | |
|---|---|---|---|
| 3,601,912 | 8/1971 | Dubbs | 38/102.91 |
| 3,908,293 | 9/1975 | Newman | 38/102.91 |
| 4,033,397 | 7/1977 | McKee | 160/393 |
| 4,345,390 | 8/1982 | Newman | 38/102.91 |

*Primary Examiner*—Howard N. Goldberg
*Assistant Examiner*—P. W. Echols
*Attorney, Agent, or Firm*—Seidel, Gonda & Goldhammer

[57] ABSTRACT

A screen tensioning and printing frame includes sets of parallel rollers coupled at their ends to corner members. Each roller has a longitudinally extending peripheral fabric locking groove defined in part by straight surfaces which converge outwardly. Adjacent and on opposite sides of the locking groove there is provided one or more fabric registration grooves on the periphery of each roller.

7 Claims, 6 Drawing Figures

FIG. 1
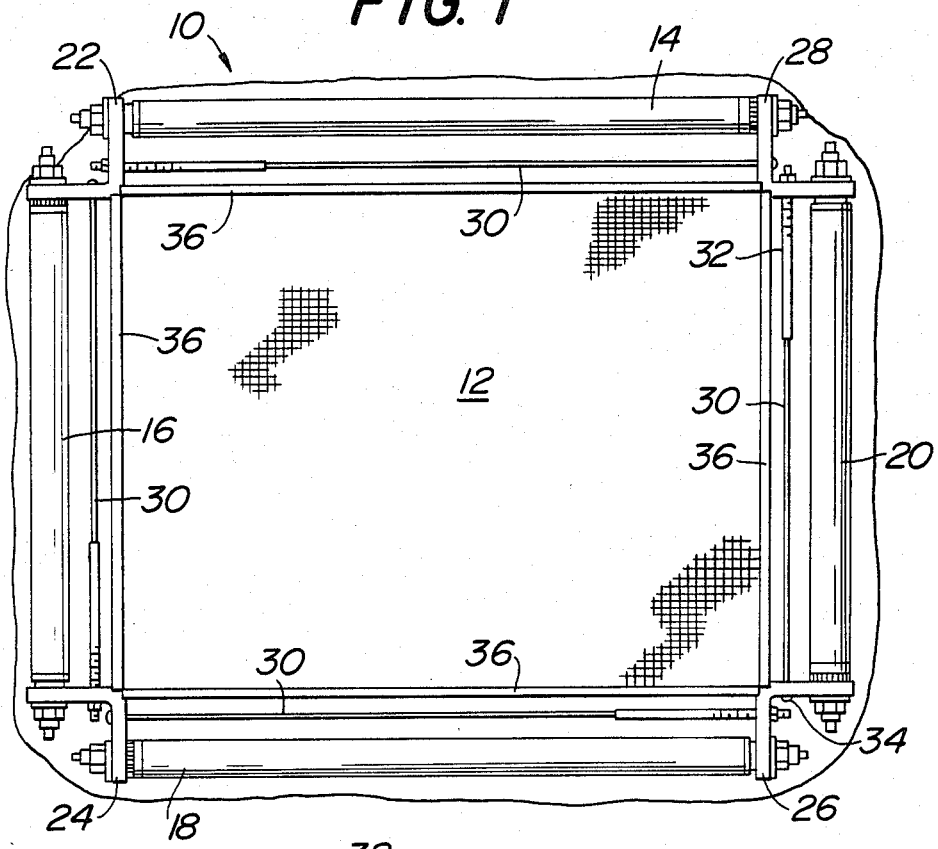
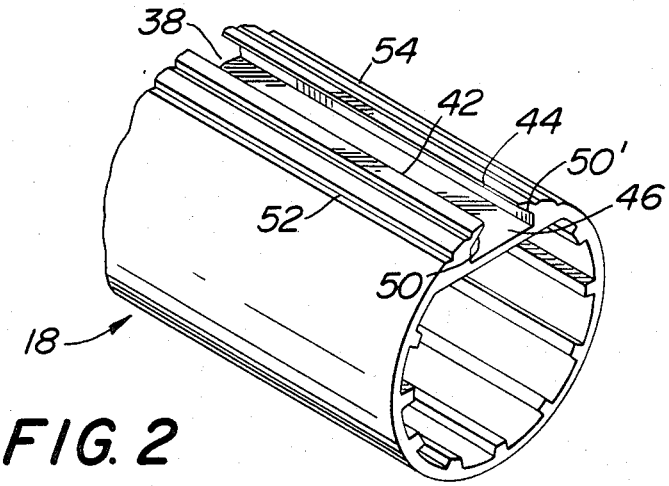
FIG. 2

FIG. 3
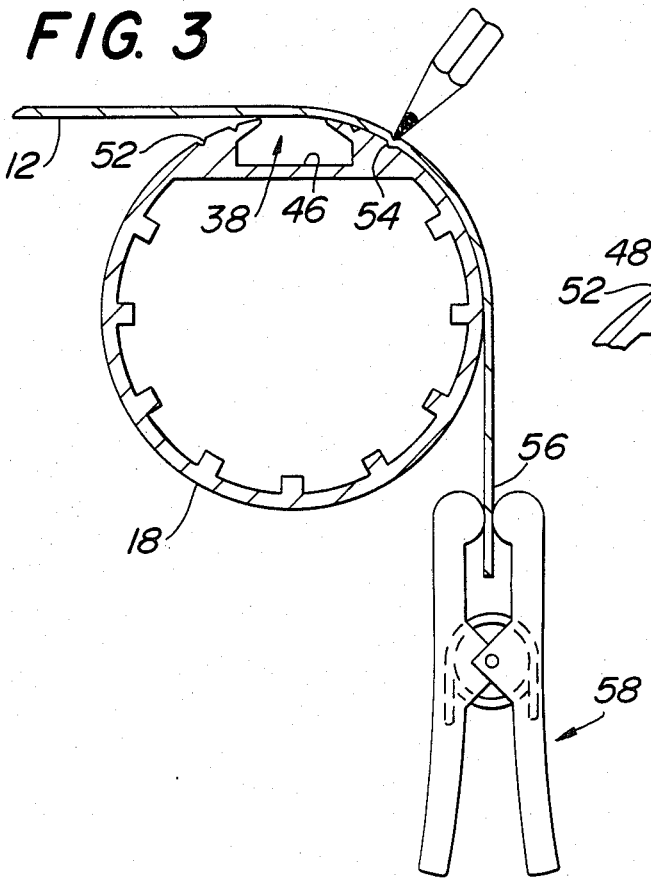
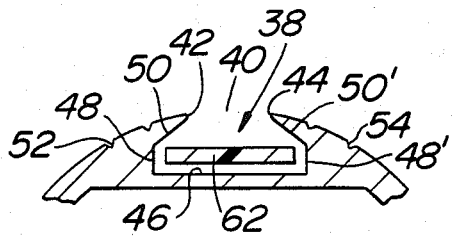
FIG. 6
FIG. 5
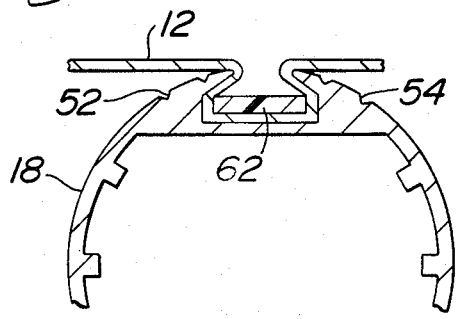
FIG. 4
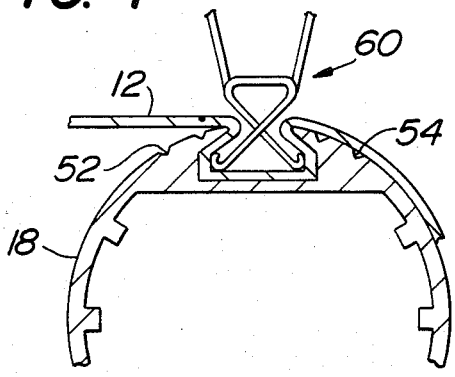

ROLLER FOR SCREEN TENSIONING AND PRINTING FRAME

BACKGROUND OF THE INVENTION

The present invention is an improvement over the screen tensioning and printing frame disclosed in U.S. Pat. No. 3,908,293 dated Sept. 30, 1975. The present invention is directed to solution of the following problems associated with the frame disclosed in said patent. A wide range of fabrics must be utilized with thicknesses between 0.001 and 0.020 with thread counts varying from 12 to 500 per inch. In the median range of the fabrics that are utilized in the industry, the frame in said patent works satisfactorilly. With very thin or slippery fabric, there is a problem with the fabric slipping out of the locking groove when tension is applied to the fabric. With very coarse fabrics, there is a problem of trying to insert the locking strip into the locking groove. When the size of the groove was increased to accommodate the coarse fabrics, this aggravated the problem with respect to the thin fabrics.

A screen tensioning and printing frame should be capable of handling fabrics across the entire range. Thus, it would be impractical to have a frame which could only be used with thin fabrics or which could only be used with coarse fabrics. Efforts in order to solve the problem by increasing the size of the groove were unsuccessful.

Another problem associated with the frame disclosed in the above mentioned patent is the problem of obtaining uniform tension. Thus, the frame in the above mentioned patent lacks any visual or mechanical feature to facilitate assurance of proper tensioning and registration of the fabric with respect to the locking groove.

The present invention is based on recognition of the problems associated with the prior art and a solution of such problems.

SUMMARY OF THE INVENTION

The present invention is directed to a roller for a screen tensioning and printing frame. The roller has a longitudinally extending peripheral locking groove to facilitate locking a portion of a fabric thereto. The groove has an open gap at the periphery of the roll and a base surface radially inwardly of the gap. Side walls of the groove include flat surfaces converging to the gap. The included angle between the base surface and the converging surfaces is preferably about 35°–45° but may be in the range 25°–60°.

It is an object of the present invention to provide a novel roller for a screen tensioning and printing frame.

Other objects and advantages will appear hereinafter.

For the purpose of illustrating the invention, there is shown in the drawings a form which is presently preferred; it being understood, however, that this invention is not limited to the precise arrangements and instrumentalities shown.

FIG. 1 is a plan view of a screen tensioning and printing frame incorporating the present invention.

FIG. 2 is a partial perspective view of one end of a roller.

FIG. 3 is a sectional view of a roller and illustrates the manner in which fabric may be marked.

FIG. 4 is a view similar to FIG. 3 but showing a subsequent stage.

FIG. 5 is a view similar to FIG. 4 but showing a subsequent and completed stage.

FIG. 6 is a partial sectional view of the roller illustrating the locking strip in the locking groove without fabric.

DETAILED DESCRIPTION

Referring to the drawing in detail, wherein like numerals indicate like elements, there is shown in FIG. 1 a screen tensioning and printing frame designated generally as 10. A screen fabric 12 is applied to one face of the frame.

The frame 10 has its main structural element comprised of a plurality of rollers designated 14 and 18 parallel to each other and rollers 16 and 20 which are parallel to each other. Rollers 14 and 18 are mutually perpendicular with respect to rollers 16 and 20. The rollers are rotatively supported at their ends by corner members 22, 24, 26 and 28.

The rollers are preferably hollow rollers made from a light weight, non-corrosive material such as aluminum. The corner members are rigid members made from a lightweight non-corrosive material such as aluminum, steel and plastic.

If desired, a pre-stressing means may extend between adjacent corner members for applying a camber to the associated roller. As shown in FIG. 1, such tension means includes a cable or rod 30 having threads 32 at one end and a head 34 at the other end. Head 34 is sufficiently large so that it cannot pass through a hole in a corner member. A nut is provided with an opposite corner member for cooperation with the threads 32. Each head 34 is non-rotatable with respect to its associated corner member. Rotation of a nut will apply a camber to the associated roller whereby the center portion of the roller will be bowed outwardly. Alternatively, means may be provided to prevent the rollers from bowing inwardly as disclosed in U.S. Pat. No. 4,345,390.

If desired, each roller may be associated with its corner members in a manner as described in the above-mentioned U.S. Pat. No. 3,908,293 and illustrated in FIG. 4 thereof for locking each roller in their predetermined rotative position so that a desired tension is applied to a screen fabric 12. Alternatively, the association of rollers and corner members may be as disclosed in U.S. Pat. No. 4,345,390. If desired, the frame 10 may have a dam member 36 associated with each roller as described in the above-mentioned patents.

The rollers are identical. Hence, only roller 18 will be described in detail. Referring to FIGS. 2–6, the roller 18 is extruded with a longitudinally extending peripheral groove 38 having a gap 40 extending between the edges 42, 44 at the periphery of the roller. The bottom of the groove 38 is defined by a base surface 46. Surface 46 constitutes a chord with respect to the cylindrical peripheral surface of the roller 18. By experimentation, I have found that the ratio of the width of gap 40 with respect to the width of base surface 46 should be in a particular range.

Rollers of the type disclosed in the first mentioned patent and sold commercially have a ratio of the width of the gap to the width of the base surface of approximately 0.42. In a roller in accordance with the present invention and having the same outer diameter of $1\frac{5}{8}$ of an inch, the width of gap 40 is 5/16 inches and the width of the base surface 46 is $\frac{1}{2}$ inch. Thus, the ratio of the width of gap 40 to the width of base surface 46 is about 0.64. The width of base surface 46 was only increased by 0.010 inches over the width of the corresponding base surface in the grooves of the roller disclosed in the above mentioned patents.

The side walls of the groove 38 will include wall portions 48, 48' which are generally perpendicular to the base surface 46, and surfaces 50, 50' which converge to the edges 42, 44 respectively. The angle between surfaces 50, 50' and surface 46 may be 25° to 60° and preferably is 35°–45°. The depth of groove 38 is approximately 1/32 of an inch deeper than the depth of the corresponding groove on the rollers of the above mentioned patents. Wall portions 48, 48' were changed so as to be straight and have a height of about 0.1 inches as compared with the curved wall portions having a height of 0.06 in said patents.

On one side of the groove 38, the periphery of roller 18 is provided with one or more registration grooves 52. On the opposite side of the groove 38, the periphery of roller is provided with one or more registration grooves 54. The grooves 52 and 54 are parallel to the longitudinal axis of the roller 18.

Each roller is attached to one edge portion of the fabric 12 in the same manner. Referring to FIG. 3, an edge portion of the fabric 12 is positioned partially around the roller 18 as illustrated. A plurality of clips 58 of the same weight are releasably attached to an edge portion 56 of the fabric 12. Each of the clips 58 constitutes a weight which provides an initial tension on the fabric 12. Thereafter, a pencil or other marking device is utilized to provide a registration mark on the fabric 12 at spaced points across the width of the fabric by tracing the pencil point along one of the grooves such as groove 54 at locations above the clips 58. The registration marks will be parallel to the longitudinal axis of roller 18.

Thereafter, the weights defined by clips 58 are removed. The fabric 12 is repositioned so that the markings on the fabric are now juxtaposed to one of the edges such as edge 42 or to one of the grooves 52. The edge portion of the fabric 12 is then retained in that position by a plurality of clips 60. Thereafter, the fabric 12 is tensioned by pulling at one end and a locking strip 62 is introduced longitudinally from one end into the groove 38. As the leading end of strip 62 reaches each clip 60, the clips are removed. Lock strip 62 is preferably a polymeric plastic material having a thickness of about 0.030 inches with the preferred material being polypropylene. The groove 38 is sufficiently deep and wide so as to accommodate coarse fabrics having a thickness of 0.020 inches while at the same time will prevent thin slippery fabrics from pulling out of the groove.

Any tendency of the fabric to pull out of the groove will force locking strip 62 to tend to pivot in a clockwise direction in FIG. 6 and contact the surface 50. Increased pressure on the fabric will result with increased pivoting of the locking strip 62 and increased pressure against surface 50. Since the fabric 12 was marked and the marks were juxtaposed to the edge 42, initial tension along the length of the fabric 12 associated with roller 18 is uniform. Thereafter, roller 18 may be rotated to attain the desired fabric tension as described in the above mentioned patents.

The present invention may be embodied in other specific forms without departing from the spirit or essential attributes thereof and, accordingly, reference should be made to the appended claims, rather than to the foregoing specification, as indicating the scope of the invention.

I claim:

1. A roller for a screen tensioning and printing frame comprising a roller having means thereon for locking thereto a portion of fabrics which are in a range from fine down to fabrics which are coarse, said means including a longitudinally extending peripheral locking groove to facilitate locking a portion of a fabric thereto, said groove being symmetrical and having an open gap at the periphery of the roll and a flat base surface radially inwardly of the gap, side walls on opposite sides of the groove including flat surfaces converging to the gap, the included angles between said base surface and said converging surface being about 25° to 60°.

2. A roller in accordance with claim 1 wherein said angle is 35° to 45°.

3. A roller in accordance with claim 1 including means on said roller to facilitate marking of fabric for purposes of registration, said registration means including at least one longitudinally extending outer peripheral groove on opposite sides of said gap.

4. A roller in accordance with claim 1 wherein the side walls include surfaces generally perpendicular to the base surface and extending to an end of said converging surfaces remote from said gap.

5. A roller in accordance with claim 1 wherein the ratio of the width of the gap to the width of the base is about 0.6.

6. A roller for a screen tensioning and printing frame comprising a roller having means thereon for locking thereto a portion of fabrics which are in a range from fine down to fabrics which are substantially coarser than fine, said means including a longitudinally extending outer peripheral locking groove to facilitate locking a portion of a fabric thereto, said groove having an open gap at the periphery of the roll and a base surface radially inwardly of the gap, side walls of the groove including flat surfaces converging to the gap, the included angles between the base surface and the converging surfaces being about 25° to 60°, means on said roller to facilitate marking of fabric for purposes of registration including at least one longitudinally extending outer peripheral groove on opposite sides of said gap, the depth of the registration grooves being substantially less than the depth of said locking groove.

7. A roller for a screen tensioning and printing frame comprising a roller having means thereon for locking thereto a portion of fabrics which are in a range from fine down to fabrics which are substantially coarser than fine, said means including a longitudinally extending peripheral locking groove to facilitate locking a portion of a fabric thereto, said groove having an open gap at the periphery of the roll and a flat base surface radially inwardly of the gap, side walls on opposite sides of the groove including surfaces converging to the gap and further surfaces generally perpendicular to said base surface and extending to one end of said converging surfaces, the included angles between the base surface and the converging surfaces being about 25° to 60°.

* * * * *